US008600265B2

(12) United States Patent
Kinokuni et al.

(10) Patent No.: US 8,600,265 B2
(45) Date of Patent: Dec. 3, 2013

(54) IMAGE FORMING APPARATUS

(75) Inventors: Jiro Kinokuni, Abiko (JP); Michihiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/946,099

(22) Filed: Nov. 15, 2010

(65) Prior Publication Data

US 2011/0116834 A1 May 19, 2011

(30) Foreign Application Priority Data

Nov. 19, 2009 (JP) ..... 2009-264315
Oct. 20, 2010 (JP) ..... 2010-235526

(51) Int. Cl.
*G03G 21/00* (2006.01)

(52) U.S. Cl.
USPC ..... 399/128; 399/127; 399/55; 399/50; 399/343

(58) Field of Classification Search
USPC ..... 399/50, 55, 66, 127, 149, 150, 343
See application file for complete search history.

(56) References Cited

U.S. PATENT DOCUMENTS 6,591,072 B2 * 7/2003 Hashimoto et al. ..... 399/50
7,596,331 B2 9/2009 Kinokuni
2007/0065177 A1 * 3/2007 Yamashita et al. ..... 399/127
2007/0122190 A1 * 5/2007 Kitajima ..... 399/129
2010/0092223 A1 4/2010 Kinokuni et al.

FOREIGN PATENT DOCUMENTS

JP 63-149669 A 6/1988
JP 2000-293083 A 10/2000

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes a photosensitive member; a charging device for electrically charging the photosensitive member; an exposure device for exposing to light the photosensitive member charged by the charging device to form an electrostatic image on the photosensitive member; a developing device for developing the electrostatic image on the photosensitive member with toner to form a toner image; a transfer portion for transferring the toner image from the photosensitive member onto an image receiving member; a toner charging portion, disposed upstream of the charging device and downstream of the transfer portion with respect to a rotational direction of the photosensitive member, for electrically charging the toner remaining on the photosensitive member without being transferred onto the image receiving member; and control portion for controlling the charging device and the exposure device so that a stripe-shaped electrostatic image is repeatedly formed in substantially parallel to a longitudinal direction of the photosensitive member and discharges the toner, deposited on the toner charging portion, to the photosensitive member.

8 Claims, 8 Drawing Sheets

IMAGE FORMING APPARATUS

FIELD OF THE INVENTION AND RELATED ART

The present invention relates to a cleaner-less type electrophotographic image forming apparatus.

The image forming apparatus of the cleaner-less type in which transfer residual toner on a photosensitive member after a transfer step is subjected to cleaning simultaneously with development by a developer device, thus being collected from the surface of the photosensitive member and then being utilized again, has been conventionally proposed. In the cleaner-less type, compared with a blade cleaning type in which the transfer residual toner is subjected to cleaning by rubbing the photosensitive member with a blade, an amount of abrasion of the photosensitive member can be decreased, so that a lifetime of the photosensitive member can be increased.

In such a cleaner-less type image forming apparatus, the transfer residual toner is collected by the developing device in a manner in which electric charge is adjusted by an adjusting member disposed downstream of a transfer portion.

However, in the toner deposited on the photosensitive member at a position downstream of the transfer portion, there are toner charged to a normal charge polarity and toner charged to an opposite polarity to the normal charge polarity in mixture. For example, when a voltage of an identical polarity to the normal charge polarity of the toner is applied in order to adjust the electric charge of the transfer residual toner to the normal charge polarity, a part of the toner charged to the opposite polarity is deposited on the adjusting member. Further, the adjusting member for adjusting the electric charge of the transfer residual toner is lowered in electric charge adjusting power of the transfer residual toner by the deposition of the toner.

When the electric charge adjusting power of the transfer residual toner by the adjusting member is lowered, the transfer residual toner is not readily collected by the developing device. As a result, an image defect such that a toner image is deposited at a non-image portion is caused.

For that reason, Japanese Laid-Open Patent Application (JP-A) Sho 63-149669 describes a mode in which the transfer residual toner deposited on the adjusting member is discharged onto the photosensitive member to clean the adjusting member by applying a bias of an opposite polarity to that of the bias applied to the adjusting member during image formation (hereinafter, referred to as a cleaning mode). By discharging the toner deposited on the adjusting member onto the photosensitive member, the occurrence of the image defect such that the toner is accidentally deposited at the non-image portion has been suppressed.

In recent years, there is a tendency that an amount of the transfer residual toner deposited on the adjusting member becomes large by continuous output of an image with a high print ratio such as a photographic image or by speed-up of the image forming apparatus. When the amount of the transfer residual toner deposited on the adjusting member is increased, there is a need to increase an execution frequency of the cleaning mode or to increase an execution time. However, a period in which the cleaning mode is executed is a down time in which the image formation cannot be effected, so that a lowering in productivity is caused. JP-A 2000-293083 discloses, in order to suppress the execution time of the cleaning mode, a method in which application start and stop of the bias are repeated in a short time.

However, also in the method disclosed in JP-A 2000-293083, there was room for reduction in down time.

SUMMARY OF THE INVENTION

A principal object of the present invention to provide an image forming apparatus having a solved problems described above.

According to an aspect of the present invention, there is provided an image forming apparatus comprising:

a photosensitive member;

a charging device for electrically charging the photosensitive member;

an exposure device for exposing to light the photosensitive member charged by the charging device to form an electrostatic image on the photosensitive member;

a developing device for developing the electrostatic image on the photosensitive member with toner to form a toner image;

transfer means for transferring the toner image from the photosensitive member onto an image receiving member;

toner charging means, disposed upstream of the charging device and downstream of the transfer means with respect to a rotational direction of the photosensitive member, for electrically charging the toner remaining on the photosensitive member without being transferred onto the image receiving member; and control means for controlling the charging device and the exposure device so that a stripe-shaped electrostatic image is repeatedly formed in substantially parallel to a longitudinal direction of the photosensitive member and discharges the toner, deposited on the toner charging means, to the photosensitive member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described more specifically.

[Embodiment 1]

1. General Structure of Image Forming Apparatus

Figure 1:
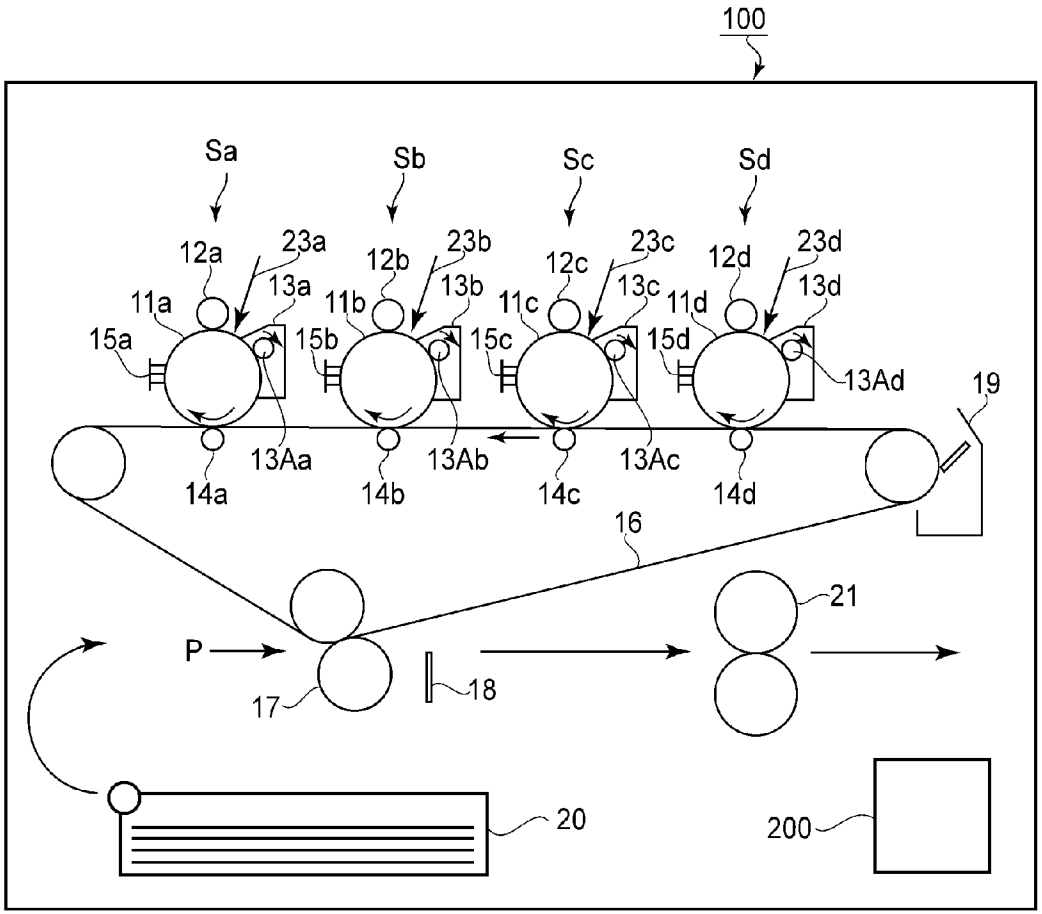
FIG. 1 is a schematic view for illustrating a structure of an image forming apparatus in Embodiment 1.

FIG. 1 shows a schematic structure of an image forming apparatus in this embodiment according to the present invention. In this embodiment, an image forming apparatus 100 is of an intermediary transfer type in which four image forming portions Sa to Sd where color images of magenta, cyan, yellow and black are formed, respectively.

In this embodiment, the image forming apparatus 100 includes drum-like electrophotographic photosensitive members (photosensitive drums) 11 (11*a* to 11*d*) which are disposed rotatably in directions indicated by arrows. Around the photosensitive drums 11, along their rotational directions, charging rollers 12 (12*a* to 12*d*) as a charging means, developing devices 13 (13*a* to 13*d*) as a developing means, and primary transfer rollers 14 (14*a* to 14*d*) as a primary transfer means are disposed. Further, around the photosensitive drums 11, toner charging means 15 (15*a* to 15*d*) and an intermediary transfer belt 16 which is an intermediary transfer member as a recording medium are disposed. Around the intermediary transfer belt 16, a secondary transfer means 17, a paper separating means 18 and an intermediary transfer belt cleaning means 19 are disposed.

Further, at a lower portion of the image forming apparatus, a sheet feeding device (sheet feeding cassette) 20 for feeding recording paper P toward the secondary transfer means 17 is disposed. Further, on a downstream side of the separating device (means) 18 in a conveyance direction of the recording paper P separated by the separating means 18, a fixing device 21 and a sheet discharging tray 22 are disposed.

Obliquely above each of the photosensitive drums 11, a laser exposure device 23 as an exposing means is disposed and is configured to project a laser beam modulated depending on image information onto the surface of the photosensitive drum 11. Here, the laser exposure device 23 scans the surface of the photosensitive drum 11 in a longitudinal direction with the laser beam (light) reflected by a polygon mirror which rotates at high speed, thus forming an electrostatic image on the photosensitive drum 11.

The toner charging means 15 (15*a* to 15*d*) will be described in detail. The respective toner charging means 15 (15*a* to 15*d*) have the same constitution and thus will be collectively described as the toner charging means 15.

In this embodiment, the toner charging means 15 is a charging brush constituted by fibers. As the fibers, e.g., with respect to a fixed brush, electroconductive rayon fibers having a fineness of 6 denier, a pile length of 5 mm and a fiber density of 100 KF. As other fibers, nylon fibers or polyester fibers may also be used. These fibers may desirably have the fineness of 2-10 denier, the pile length of 3-8 mm and the fiber density of 50-500 KF. Further, with respect to a shape, it is also possible to use a brush roller or a charging roller.

A bias to be applied to the toner charging means 15 is a DV voltage of an identical polarity to the normal charge polarity of the toner (normal toner).

The image forming apparatus having the above constitution in this embodiment is operable in an image forming mode in which an electrophotographic process for image formation is performed and in a cleaning mode in which cleaning of the toner charging means 15 is performed. Next, a procedure of the image forming mode will be described. In this embodiment, the image forming portions Sa to Sd have the same constitution and thus in the following description, suffixes a, b, c and d for discriminating the respective image forming portions will be omitted from the description. That is, the image formation for each of magenta, cyan, yellow and black is effected in accordance with the same procedure.

When the power is turned on, by a main motor (not shown), the photosensitive drum 11 and the charging roller 12 starts their rotation at a predetermined rotational speed. When an instruction to execute the image forming operation is provided, a DC voltage biased with an AC voltage is applied from a high voltage source (not shown) to the charging roller 12, so that the surface of the photosensitive drum 11 is electrically charged to a predetermined potential.

From the laser exposure device 23, the laser beam modulated depending on the image information is projected onto the surface of the photosensitive drum 11, so that an image-wise latent image (electrostatic image) is formed on the surface of the photosensitive drum 11. When the formed electrostatic image reaches a position of the developing device 13 by the rotation of the photosensitive drum 11, the electrostatic image is developed and visualized with the toner in contact with a developing roller of the developing device 13, so that a toner image is formed on the photosensitive drum 11.

The toner image formed on the photosensitive drum 11 by the development is transferred onto the intermediary transfer belt 16 by applying a bias, of an opposite polarity to the toner charge polarity, to the primary transfer means 14.

As described above, the toner images similarly formed on the photosensitive drums 11*a* to 11*d* are successively transferred onto the intermediary transfer belt 16 as the recording medium and thereafter are collectively transferred onto the recording paper P by the secondary transfer means 17.

On the other hand, from the sheet feeding device (sheet feeding cassette) 20, the recording paper P is fed with timing when the toner images formed on the intermediary transfer belt 16 reach the position of the secondary transfer means 17. The toner images are transferred from the intermediary transfer belt 16 onto the recording paper P. The recording paper P on which the toner images are transferred is separated from the intermediary transfer belt 16 by the separating device 18 and is conveyed to the fixing device 21 in which the toner images are fixed on the recording paper P. Then, the recording paper P is discharged onto the sheet discharging tray 22.

Here, in a transfer process of the toner images onto the recording paper P, the toner remaining on the intermediary transfer belt 16 without being transferred onto the recording paper P is collected by the intermediary transfer belt cleaning means 19 by the rotation of the intermediary transfer belt 16.

On the other hand, the toner (transfer residual toner) remaining on the photosensitive drum 11 without being transferred onto the intermediary transfer belt 16 is processed by the bias applied to the toner charging means 15 when the transfer residual toner passes through a contact portion between the photosensitive drum 11 and the charging roller 15 as the toner charging means. Hereinafter, this processing method of the transfer residual toner by the toner charging means 15 will be described more specifically.

2. Charge Adjusting of Transfer Residual Toner

A major part of the transfer residual toner remaining on the photosensitive member without being transferred from the photosensitive member onto the intermediary transfer belt has almost no normal charge polarity in many cases. In such a situation, in the transfer residual toner remaining on the photosensitive member, a reversely charged toner component is dominant. Here, the reversely charged toner refers to the toner charged to the opposite polarity to the normal charge polarity of the toner.

When such the reversely charged toner passes through the contact portion between the photosensitive drum 11 and the charging roller 15, by applying the bias of the identical polarity to the normal charge polarity of the toner to the toner charging means 15, electric discharge of a certain amount or more is generated at the contact portion. As a result, electric charge of the same polarity as the normal charge polarity of the toner is imparted to the reversely charged toner. By this processing, the transfer residual toner having passed through the contact portion between the photosensitive drum 11 and the toner charging means 15 passes through the charging means 12 and then is collected by the developing device 13.

However, on the other hand, the transfer residual toner which has not been subjected to sufficient electric charge impartment by the electric discharge at the contact portion between the photosensitive drum 11 and the toner charging means 15 is deposited on the toner charging means 15. This may be attributable to deposition of the reversely charged toner, on the toner charging means 15, which has not been sufficiently adjusted in electric charge since the bias of the same polarity as the normal toner charge polarity is applied.

As described above, the transfer residual toner remaining on the photosensitive drum 11 is collected by the developing device 13 and the toner charging means 15, so that a cleaner system for cleaning the surface of the photosensitive member is realized.

However, with continuous image formation, the reversely charged toner collected by the toner charging means 15 has been gradually deposited. Then, in the case where a deposition amount of the reversely charged toner reaches a limit (predetermined value) at which the toner charging means 15 cannot perform the charge impartment, the transfer residual toner as the reversely charged component having passed through the toner charging means 15 is deposited on the charging means 12. For this reason, the charging means 2 was unable to uniformly charge the surface of the photosensitive drum 11, so that fog or image defect due to charge non-uniformity was caused.

The problem described above is solved in this embodiment by effecting cleaning control (cleaning mode) in which the toner is removed from the toner charging means 15. That is, a controller 200 executes the cleaning mode in which the deposited toner is discharged before the amount of the toner accumulated at the toner charging means exceeds the limit (predetermined value).

(Conventional Cleaning Control: Comparative Embodiment 1)

First, with respect to the cleaning control of the toner deposited on the toner charging means 15, conventional cleaning control (Comparative Embodiment 1) will be described. A conventional control method in Comparative Embodiment 1 is shown in FIGS. 2(*a*) and 2(*b*).

Figure 2:
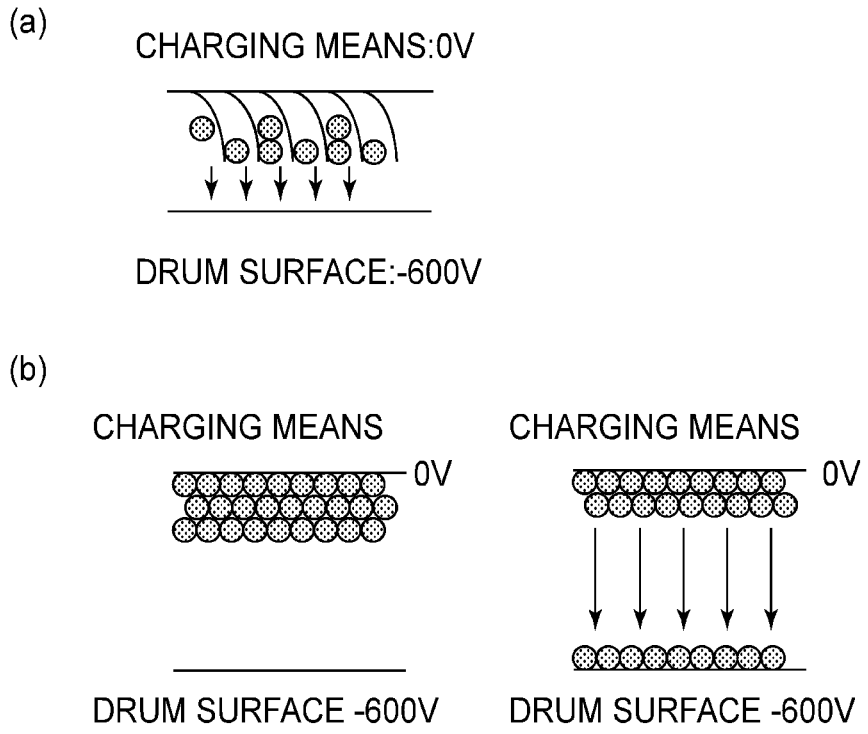
FIGS. 2(*a*) and 2(*b*) are schematic views for illustrating conventional cleaning control of a toner charging means in Comparative Embodiment 1.

In the conventional control method, as shown in FIGS. 2(*a*) and 2(*b*), in the cleaning mode, the transfer residual toner deposited on the toner charging means 15 is electrically removed. When the bias of the opposite polarity to that during the image formation is applied to the toner charging means 15, by an electric field formed between the toner charging means 15 and the photosensitive drum 11, the toner deposited on the toner charging means 15 is transferred from the toner charging means 15 onto the photosensitive drum 11.

Further, a time necessary to effect the cleaning control varies depending on the amount of the toner deposited on the toner charging means 15. For example, in the case where the image formation is continuously effected with a high print ratio of 30% duty, a long cleaning time of about 15 sec per 50 sheets is required. In the cleaning time when the cleaning control is effected, the photosensitive drum 11 and the toner charging means 15 are electrically damaged.

Next, the electrical damage on the photosensitive drum 11 is calculated.

In the image forming apparatus in Comparative Embodiment 1 is capable of continuously forming the image with 50 sheets/min. Further, a process speed (v) is 280 mm/sec, a total time of pre-rotation and post-rotation is 2.9 sec, and a time between adjacent image forming operations is 0.4 sec.

As described above, in the case of the continuous image formation with 30% duty, the cleaning control of 15 sec per 50 sheets is assumed. In this case, compared with the case of no cleaning control, the electric damage on the photosensitive drum 11 and the toner charging means 15 was about 1.25 times, so that a durable lifetime was caused to be lowered by about 20%. Further, a non-image forming time is increased and thus productivity of a print in terms of a time obtained by adding the cleaning control time to the non-image forming time (hereinafter, referred to as substantial productivity) is lowered.

(Conventional Cleaning Control: Comparative Embodiment 2)

Next, with respect to the above-described problem, another cleaning control in Comparative Embodiment 2 in which the cleaning control time is reduced will be described with reference to FIGS. 3(*a*) to 3(*c*).

Figure 3:
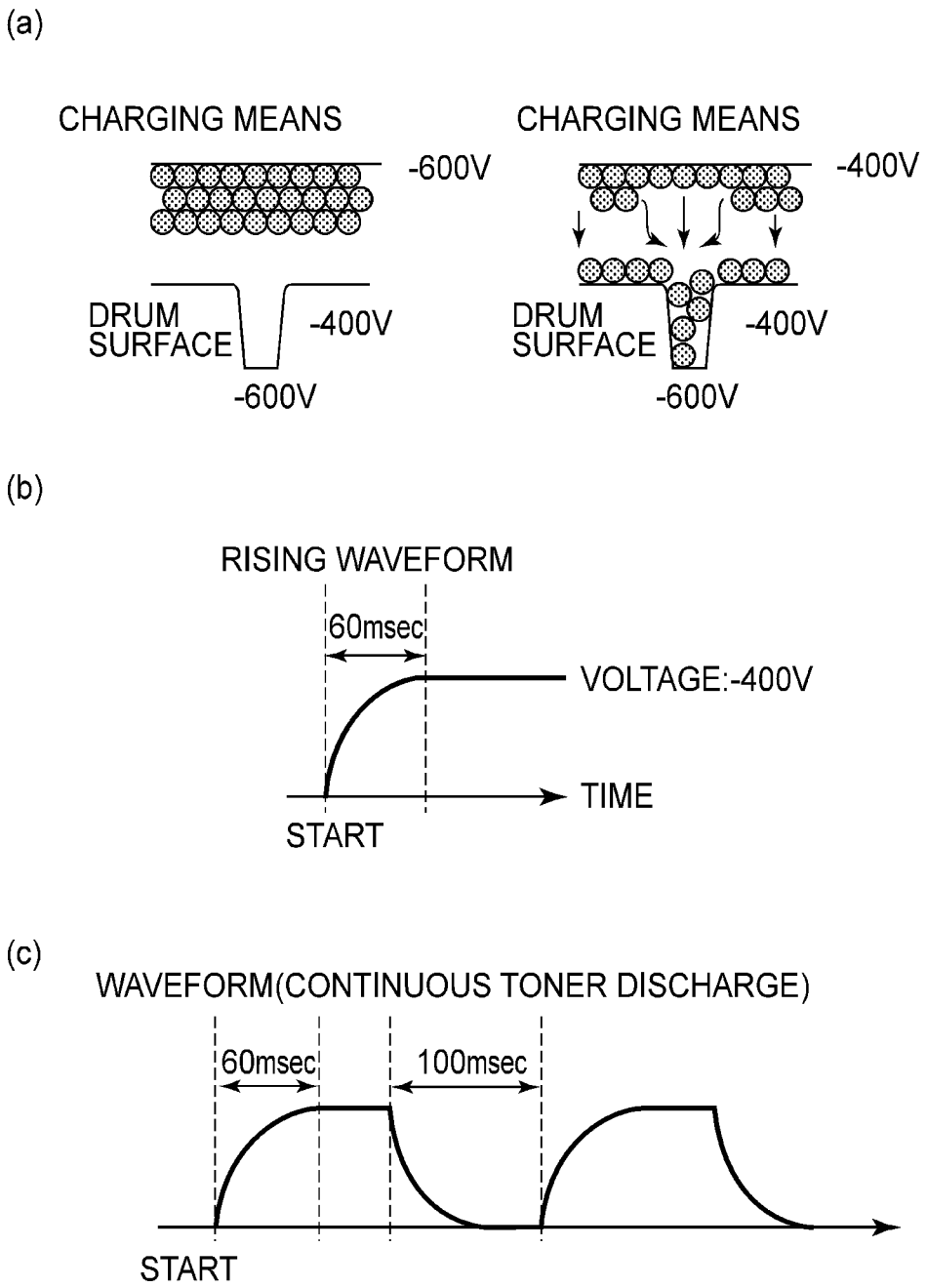
FIGS. 3(*a*), 3(*b*) and 3(*c*) are schematic views for illustrating conventional cleaning control of the toner charging means in Comparative Embodiment 2.

As shown in FIG. 3(*a*), also in this cleaning control, the transfer residual toner deposited on the toner charging means 15 is electrically removed. Further, in this cleaning control, as described in JP-A 2000-293083, the cleaning of the toner charging means is performed in a short time by repeating application start and stop of the bias in the short time. This cleaning control will be described below more specifically.

First, a DC voltage of −600 V and an AC voltage of 1800 Vpp are applied to the charging roller as the charging means, so that the photosensitive drum is changed to a potential of −600 V. Then, the DC voltage applied to the toner charging means 15 is repeated by changed alternately between −400 V and −600 V, so that an electric field is formed between the potential of the toner charging means 15 and the potential of the photosensitive drum 11. The toner deposited on the toner charging means 15 during the image formation has the polarity opposite to that of the toner subjected to the normal development. For that reason, when the voltage applied to the toner charging means 15 is −400 V and the potential of the photosensitive drum 11 is −600 V, the toner deposited on the toner charging means 15 is transferred from the toner charging means 15 onto the photosensitive drum 11 surface by an electric force. Further, in an area in which the voltage applied to the toner charging means 15 is switched from −400 V to −600 V, an electric field state is abruptly changed. By utilizing such a state, i.e., a state in which lines of electric force are concentrated, the control with high cleaning efficiency with respect to the toner charging means 15 is realized.

Referring to FIG. 3(*a*), it is understood that the toner is moved from the toner charging means 15 to the photosensitive drum 11 in the area in which the electric field is abruptly changed. The toner deposited in an area in which a potential difference between the toner charging means 15 and the photosensitive drum 11 is small is also moved by the electric field concentrated at a boundary between the small potential difference area and the large potential difference area. Further, it has been found from an experiment that an amount of movement of the toner at that time is very large and that an instantaneous toner movement amount at that time is larger than that in a large potential difference state.

However, as is understood from FIGS. 3(*b*) and 3(*c*), the abrupt change in electric field formed during the repetition of the application start and stop of the voltage had its limit from the viewpoint of a performance of the high voltage source. That is, the cleaning control in Comparative Embodiment 2 has left a problem of high voltage followability with respect to a software signal of a main assembly and a problem such that there are a limit in the number of occurrences of the electric field concentration in the short time and a limit in strength of the electric field due to a voltage waveform including a dull rising portion.

According to the cleaning control in Comparative Embodiment 2, in the case of the continuous image formation with 30% duty, the cleaning control time was suppressed to about 10 sec per 50 sheets. However, in the cleaning control in Comparative Embodiment 2, the electrical damage on the photosensitive drum 11 and the toner charging means 15 was about 1.17 times that in the case of no cleaning control, so that the durable lifetime was decreased by about 16%.

(Cleaning Control in this Embodiment)

Figure 4:
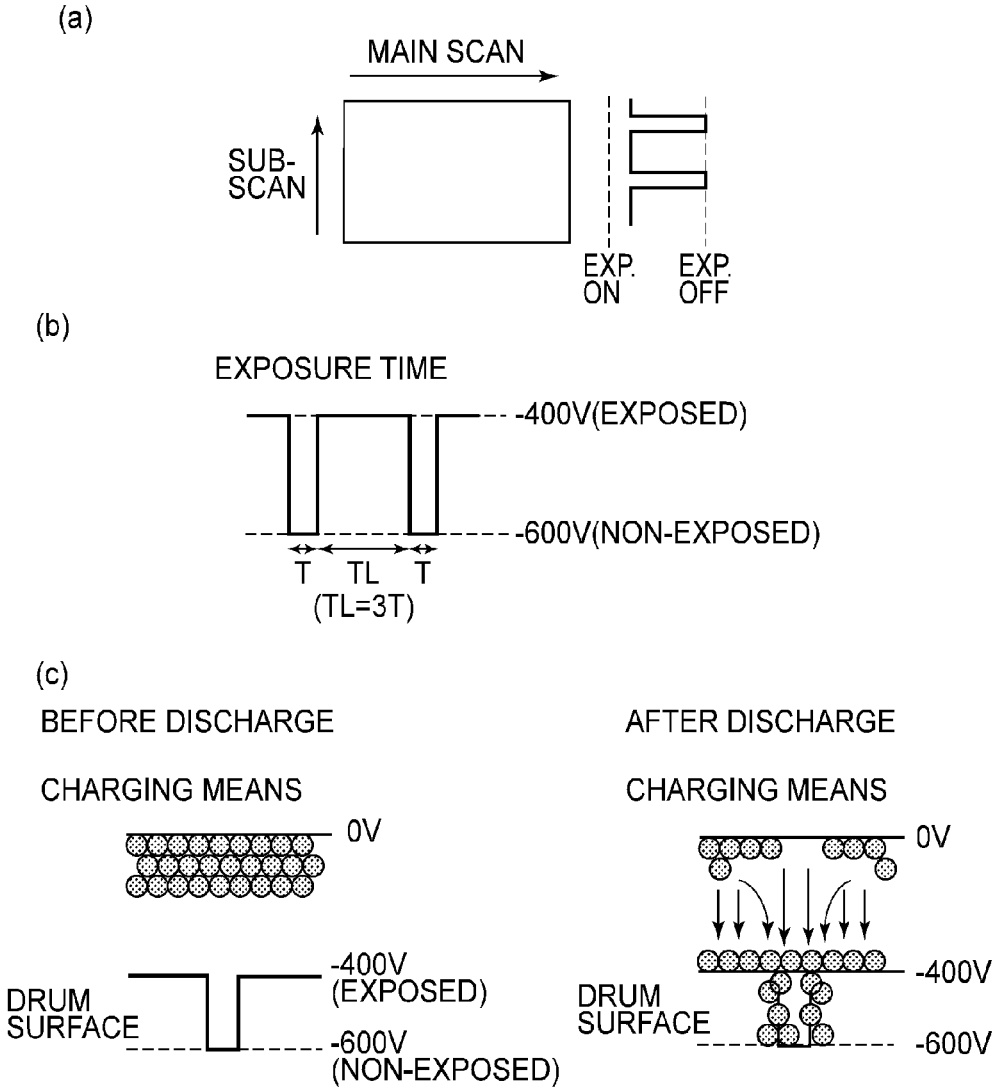
FIGS. 4(*a*), 4(*b*) and 4(*c*) are schematic views for illustrating cleaning control of the toner charging means in Embodiment 1.

Next, the cleaning control of the toner charging means 15 in this embodiment (Embodiment 1) will be described with reference to FIGS. 4(*a*) to 4(*c*).

In this embodiment, first, the surface potential of the photosensitive drum 11 is set at −600 V by the charging means 12. To the charging means 12, the DC of −600 V and the AC voltage of 1800 Vpp are applied. Then, full exposure and exposure stop are repeated at certain intervals by the exposure means 23, so that an exposed area in which the photosensitive drum surface potential is −400 V and an exposure-stopped (non-exposed) area in which the photosensitive drum surface potential is −600 V are formed. Incidentally, exposure intensity may also be appropriately set so long as an electrostatic image providing a potential difference capable of permitting discharge of the toner from the toner charging means onto the photosensitive member can be formed.

In this embodiment, the photosensitive member is scanned in its longitudinal direction with the laser light by the polygon mirror but the photosensitive drum is rotated. For that reason, stripe-shaped electrostatic images formed in this embodiment by the full exposure and the exposure stop are substantially parallel to the longitudinal direction of the photosensitive member (photosensitive drum). Further, even in the case where an LED array provided in parallel to the generatrix of the photosensitive drum, it is difficult to realize complete parallelism in view of mounting accuracy. For this reason, "substantially parallel" in this embodiment is used to mean that a level of an error in rotation and positioning of the photosensitive drum is permitted.

In this embodiment, when an exposure time of the photosensitive drum 11 by the exposure means 3 is TL, a non-exposure time of the photosensitive drum 11 by the exposure means 3 is T, and a speed of the photosensitive drum 11 is v (=280 mm/sec), the following relationships are satisfied:

$$T \times v = 212\ \mu m \text{ and } TL/T = 3$$

According to an experimental result by the present inventors, it was found that the following relationships may preferably be satisfied:

$$84.6\ \mu m \leq T \times v \leq 847\ \mu m \text{ and } TL/T > 2$$

Further, in the exposed area, the photosensitive drum 11 is uniformly exposed to light with respect to a direction (exposure main scan direction) perpendicular to the rotational direction of the photosensitive drum 11. As a result, in a boundary area between the exposed area and the non-exposed area which are formed on the photosensitive member, it is possible to form a sharper potential gap.

As described above, by a latent image potential formed on the photosensitive drum 11 and a 0 V-bias applied to the toner charging means 15, the toner is removed from the toner charging means 15 in the electric field area in which the surface potential of the photosensitive drum 11 is abruptly changed from −600 V to −400 V.

The realization of the above-described electric concentration by the exposure means 23, which is a feature of this embodiment, ensures technological superiority in that the electric field concentration area can be formed repetitively in the short time and that the limit determined by a conventional high voltage performance can be surpassed.

An actually formed stepped potential difference portion of the latent image potential is sharper that the potential difference formed by the conventional high voltage application, so that the intensity of the electric field at the portion is enhanced.

The toner removed from the toner charging means 15 in the above-described manner passes through the charging means 12 to reach the developing device 13. At this time, to the charging means 12, the voltage is not applied so that the toner is not deposited on the charging means 12. The toner which has reached the developing device 13 is mechanically collected into the developing device 13 by the rotation of a developing sleeve 13A which is a developer carrying member. In this embodiment, the developing sleeve 13A is rotated counter-directionally to the photosensitive drum 11 and a magnetic chain of the toner and a carrier is formed on the sleeve surface, so that the toner is collected by a resultant mechanical force.

Further, when the primary transfer means 17 includes a means for applying voltages of positive and negative polarities, it is also possible to employ a method in which the toner is transferred onto the intermediary transfer belt 16 and then is collected by the intermediary transfer belt cleaning means 19. In this case, the rotation of the developing sleeve is stopped so as not to collect the toner, discharged from the toner charging means onto the photosensitive member, by the developing device.

Incidentally, in this embodiment, in order to remove the toner accumulated on the toner charging means, the electrostatic image is formed on the photosensitive member by the exposure means. There is no need to develop the electrostatic image, formed for the cleaning, into an image. For that reason, control is effected so that the rotation of the developing sleeve is stopped so as to prevent the development by the developing device and so that the amount of the toner to be consumed is suppressed by stopping the application of the developing bias.

By the cleaning control as described above, in the case of the continuous image formation with 30% duty, the cleaning control was able to be effected in the cleaning control time of about 5 sec per 50 sheets. For this reason, the electrical damage on the photosensitive drum and the toner charging means is about 1.08 times that in the case of no cleaning control, so that it is possible to realize that the durable lifetime is kept at a level of about 8% lowering. Similarly, by the reduction in time required for the cleaning control, compared with Comparative Embodiments 1 and 2, the substantial productivity was able to be improved. The results of the control time and the electrical damage with respect to the cleaning control in this embodiment (Embodiment 1) and Comparative Embodiments 1 and 2 are shown in Table 1.

TABLE 1

| | 30% duty test | | |
|---|---|---|---|
| | EMB. 1 | COMP. EMB. 1 | COMP. EMB. 2 |
| Control time (sec) | ca. 5 | ca. 15 | ca. 10 |
| Electrical Damage (times) | 1.08 | ca. 1.25 | ca. 1.17 |

3. Control Execution Portion (Controller)

Figure 5:
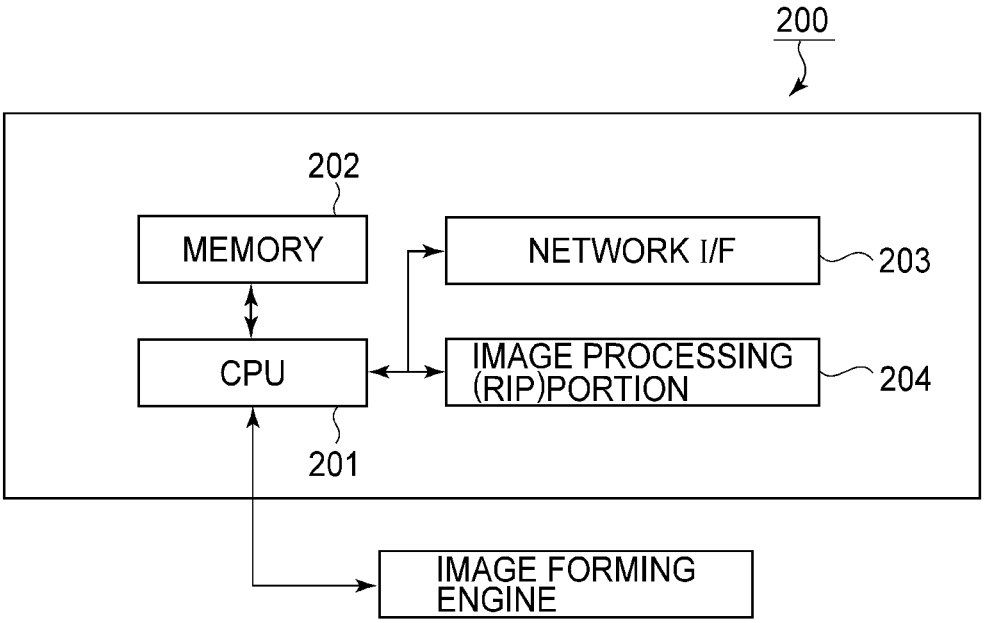
FIG. 5 is a block diagram of a control device of the image forming apparatus.

The controller 200 as the control means for executing the cleaning control described above by the image forming apparatus will be described. FIG. 5 is a block diagram for illustrating a constitution of the controller 200. The controller 200 includes a central processing unit (CPU) 201 for performing signal processing depending on a program and a memory 202 for storing the program or data. The CPU 201 executes the cleaning control described above in accordance with the program stored in the memory 202. The controller 200 also includes a network I/F (interface) 203 through which image information to be inputted from the PC into the image forming apparatus is received. The controller 200 further includes an image processing portion 204 as a dedicated circuit for converting the inputted image information into raster image data (raster image modulation). The thus constituted controller 200 controls the respective parts of the image forming apparatus.

(Control Flow)

Figure 6:
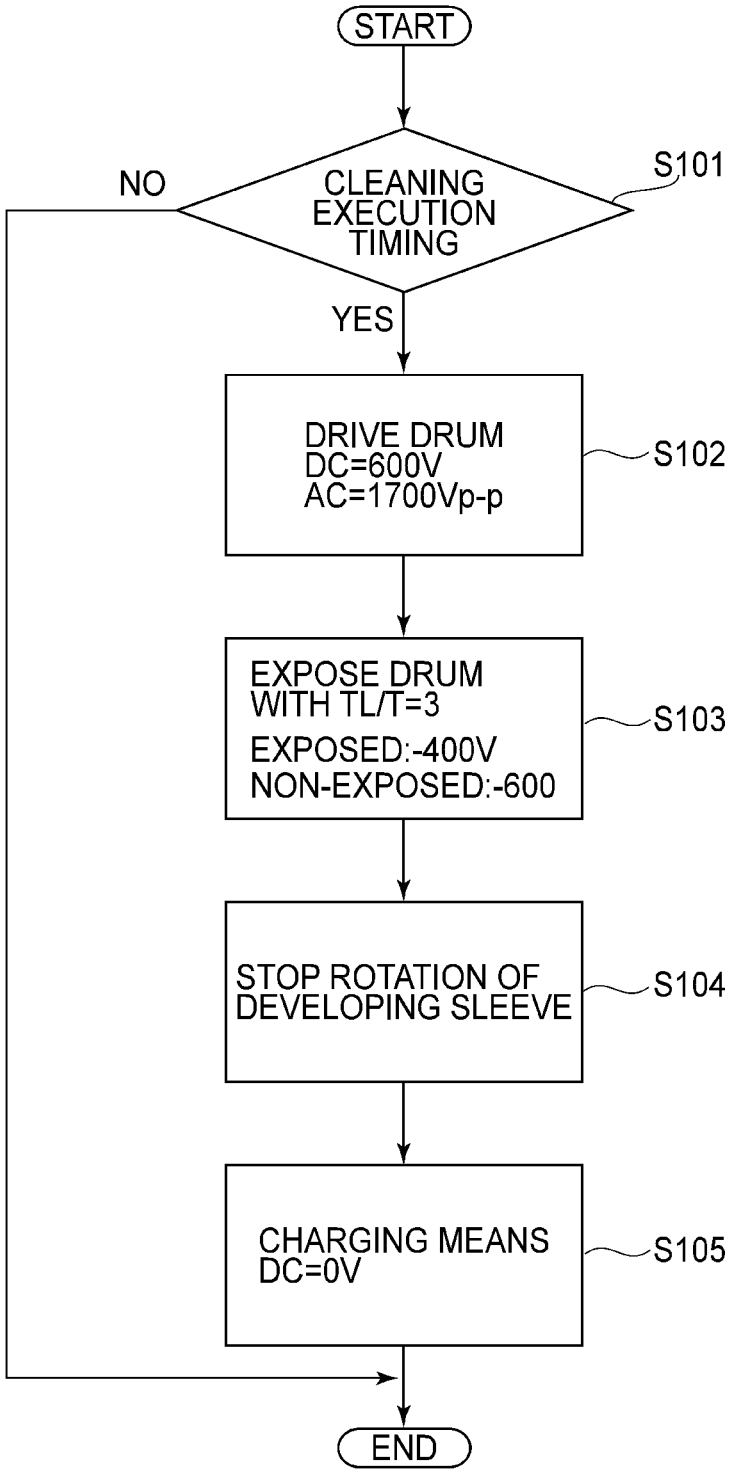
FIG. 6 is a flowchart for illustrating the cleaning control in Embodiment 1.

The cleaning control executed by the CPU 201 described above will be described along a flowchart. FIG. 6 is the flowchart for illustrating the cleaning control. The cleaning control is executed during non-image formation other than during the image formation in which the image (toner image) to be transferred onto the sheet-like recording material (recording paper).

Specifically, the cleaning control is executed during pre-rotation in which the photosensitive member is idled before the image formation or during post-rotation in which the photosensitive member is idled after the image formation. Further, the controller 200 effects the cleaning control by integrating a value of the amount, of the toner accumulated on the toner charging means, corresponding to the toner consumption amount at each pixel (so-called video counting). Specifically, in the case where a vide count value reaches a predetermined value, an interval between adjacent image forming operations for forming the image or the recording material (so-called sheet interval) is increased and during the sheet interval, the cleaning control is executed. Incidentally, the video count value is reset by the execution of the cleaning control. The operation of the controller 200 as the control means will be described in detail.

The controller 200 as the control means discriminates whether or not the timing is cleaning control execution timing. Specifically, a step S102 and later are performed when the video count value is not less than the predetermined value or during the pre-rotation or the post-rotation.

In a step S101, in the case where the timing is judged as the cleaning control execution timing, the controller 200 as the control means effects control so that the photosensitive drum is rotated and each image forming portions is operated under the above-described condition. Specifically, the control is effected so that the DC voltage of −600 V and the AC voltage of 1800 Vpp are applied to the charging means (S102).

Next, the controller 200 controls the exposure means so that the full exposure and the exposure stop are repeated at a certain interval (TL/T=3). As a result, on the photosensitive member, a stripe-like electrostatic image is formed in the exposed area (−400 V) and in the non-exposed area (−600 V) (S103).

Then, the controller 200 stops the rotation of the developing sleeve in order to suppress the toner deposition onto the exposure portion when the electrostatic image for removing the toner deposited on the toner charging means passes through the developing portion. Further, the developing bias to be applied to the developing sleeve is changed to a voltage lower than the developing bias to be applied during the image formation. Specifically, in order to suppress the toner consumption while suppressing the supply of the carrier onto the photosensitive member, the developing DC bias to be applied to the developing sleeve is changed to −300 V and the developing AC bias is changed to 0 Vp-p (OFF) (S104). Incidentally, the developing and transfer biases may only be required to be set so that the amount of the toner deposited from the developing device onto the photosensitive member is smaller than that of the toner to be supplied to the toner charging means while suppressing the toner consumption amount in the developing device during the cleaning control. Thus, the condition in the cleaning control is not limited to the above condition so long as the electrostatic image for the cleaning control is not developed with the toner. For example, the developing DC bias may also be equal to that during the image formation.

The stripe-shaped (pulse-like) electrostatic image pattern formed on the photosensitive member as described above is conveyed to an opposing portion where the electrostatic image pattern opposes the toner charging means. Then, the bias is applied to the toner charging means so that the toner accumulated on the toner charging means is moved onto the photosensitive member. Specifically, the DC bias of 0 V is applied to the toner charging means,

[Embodiment 2]

Figure 7:
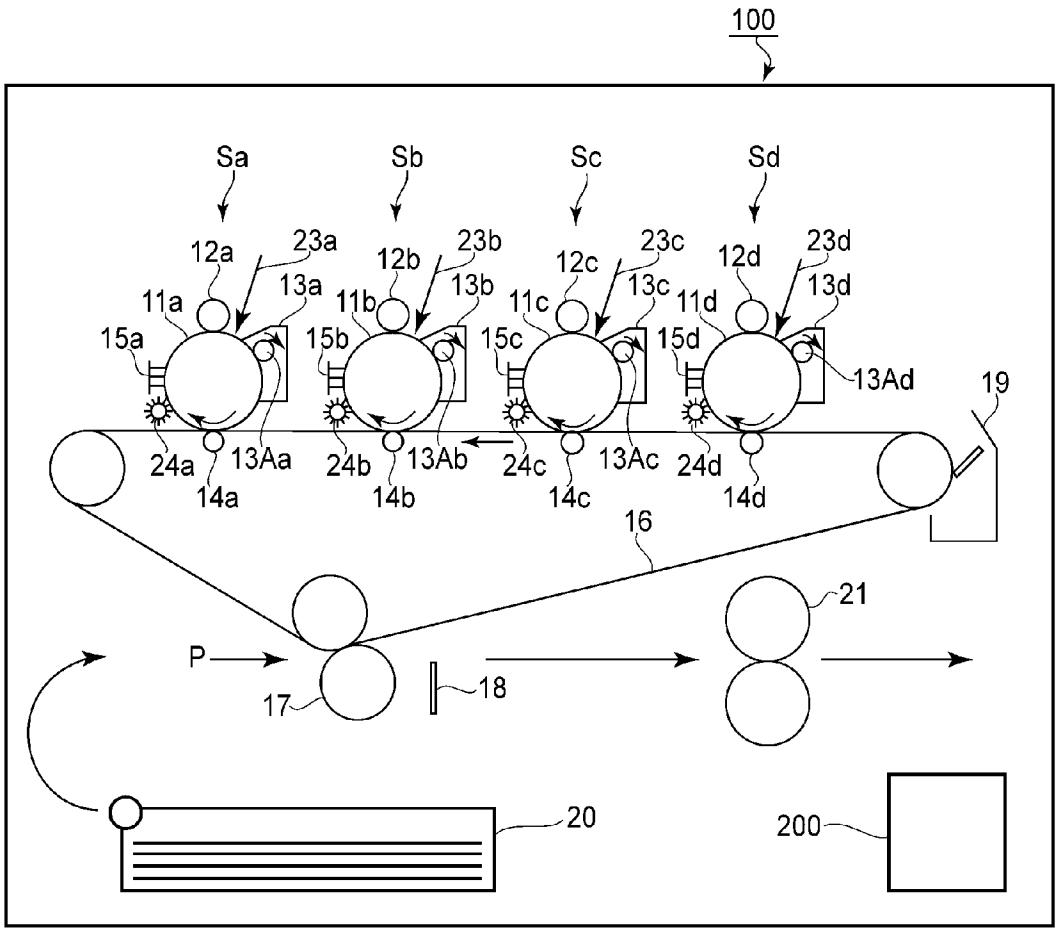
FIG. 7 is a schematic view for illustrating a structure of an image forming apparatus in Embodiment 2.

The image forming apparatus in this embodiment is shown in FIG. 7. The image forming apparatus in this embodiment have the same constitution as that of the image forming apparatus in Embodiment 1 except that the image forming apparatus in this embodiment further includes electrically discharging means 24 (24*a* to 24*d*) for the photosensitive drums 11 (11*a* to 11*d*). As the discharging means, rotatable brush roller is employed in this embodiment. The general structure of the image forming apparatus and operation portions similar to those in Embodiment 1 are represented by the same reference numerals or symbols and will be omitted from the description.

(Discharging Means)

In this embodiment, the discharging means 24 (24*a* to 24*d*) are disposed at positions which are downstream of the primary transfer means 14*a* to 14*d* and upstream of the toner charging means 15*a* to 15*d*, respectively, with respect to the rotational direction of each of the photosensitive drums 11 (11*a* to 11*d*). Incidentally, the discharging means 24 (24*a* to 24*d*) in the respective image forming portions Sa to Sd have the same constitution. Therefore, in the following, the discharging means 24*a* to 24*d* will be collectively described as the discharging means 24.

In this embodiment, as described above, the rotatable brush (brush roller) was employed as the discharging means 24. The brush roller was formed with nylon fibers having the fineness of 4 denier, the density of 150 KF/inch$^2$ and was formed in a diameter of 11 mm.

During the image formation, as an electrically discharging method of the discharging means 24, the DC voltage of the opposite polarity to the normal charge polarity of the toner charged by the charging means 12 is applied to the discharging means 24. Further, in order to perform stable electrical discharging, the DC voltage is biased with the AC voltage. In this embodiment, the voltage applied to the discharging means 24 was, e.g., in the form of the DC voltage of +500 V biased with the AC voltage of 400 Vpp.

Also with respect to the brush roller 24 as the discharging means, similarly as in the case of the toner charging means 15, the deposition amount of the transfer residual toner on the brush roller 24 during the continuous image formation is increased with lapse of time of the continuous image formation. Specifically, of the toner of the same polarity as the normal charge polarity of the toner, the toner having a large charge amount is liable to deposit on the brush roller 24. For that reason, there is a need to also subject the discharging means 24 to the cleaning control similarly as the toner charging means 15.

Then, a control method of the cleaning mode in which the brush roller 24 is cleaned will be described in detail.

(Cleaning Control)

The cleaning control in this embodiment is also effected by using the electrostatic image formed on the photosensitive member similarly as in Embodiment 1. As described above, on the brush roller 24, the toner of the same polarity as the normal charge polarity of the toner is deposited.

Here, the brush roller as the discharging means rotates. For this reason, in the case where the brush roller is cleaned by the electrostatic image formed on the photosensitive member, it is necessary to form the electrostatic image in consideration of a period of the electrostatic image for the cleaning formed on the photosensitive member and a rotation period of the brush roller.

That is, when the electrostatic image was formed along a direction perpendicular to the rotational direction of the photosensitive drum 11 similarly as in Embodiment 1, there was a possibility of an occurrence of cleaning non-uniformity on the cleaning roller.

Therefore, an efficiently cleaning method in the cleanerless constitution in which the electric charge of the transfer residual toner remaining on the photosensitive drum 11 is adjusted by the brush roller as a charge adjusting member will be described in detail.

Figure 8:
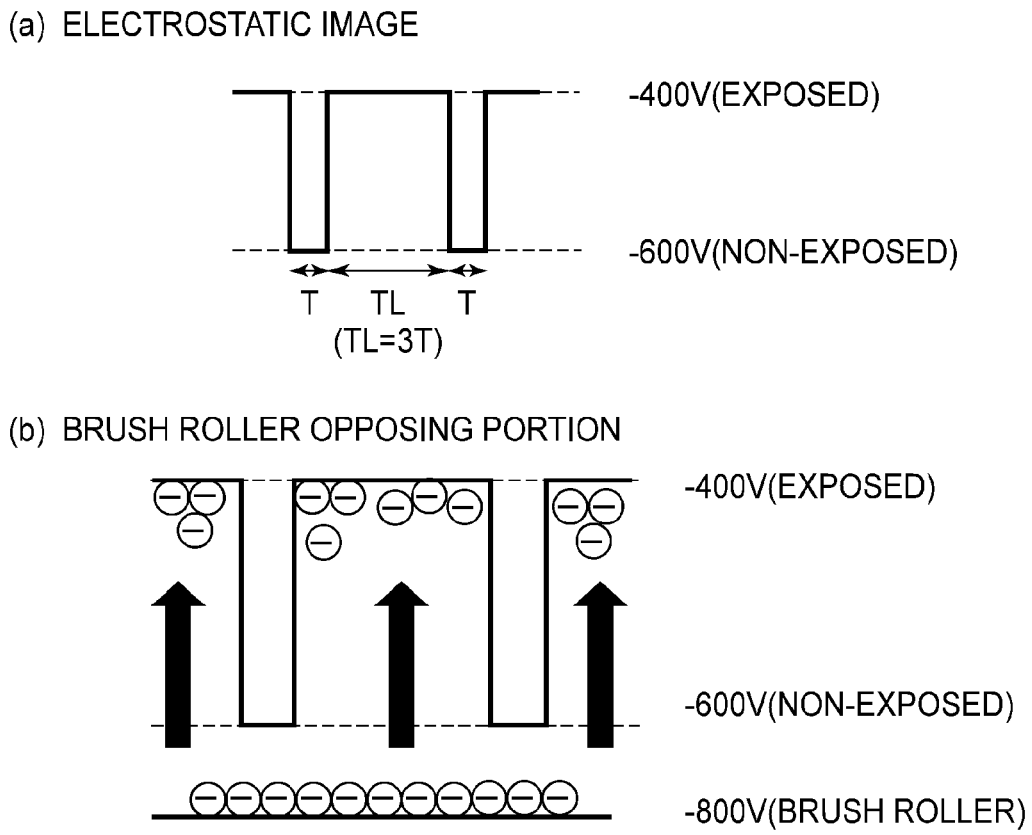
FIGS. 8(*a*), 8(*b*) and 8(*c*) are schematic views for illustrating cleaning control of the toner charging means in Embodiment 2.

FIGS. 8(*a*), 8(*b*) and 8(*c*) are schematic views for illustrating the cleaning method of the toner deposited on the brush roller in this embodiment. FIG. 8(*a*) shows the electrostatic image for the cleaning. In this embodiment, the step of forming the electrostatic image for the cleaning formed on the photosensitive member is identical to that in Embodiment 1, thus being omitted from the description. FIG. 8(*b*) schematically shows a potential relationship at a brush roller opposing portion. Similarly as in Embodiment 1, the electrostatic image for the cleaning is formed on the photosensitive member so that the exposed portion potential is −400 V and the non-exposed portion P is −600 V.

During the image formation, on the brush roller, the toner of the same polarity as the normal charge polarity of the toner is accumulated. For that reason, in order to discharge the toner deposited on the brush roller, such an electric field that the toner of the normal charge polarity is moved toward the exposed portion is formed. Specifically, when the electrostatic image for the cleaning passes through the brush roller opposing portion, the DC voltage of −800 V is applied to the brush roller so that the toner accumulated on the brush roller is concentratedly deposited on the exposed portion (−400 V) side of the electrostatic image for the cleaning.

As a result, the toner accumulated on the brush roller during the image formation can be efficiently moved onto the photosensitive member. Here, there is a possibility of an occurrence of non-uniformity of the discharge of the toner since the discharging means is the brush roller as described above. The occurrence of the non-uniformity can be suppressed by setting one cycle of the electrostatic image for the cleaning at 200 msec. Specifically, a ratio of an outer circumferential length of the roller to the length of one cycle is controlled so as not to be an integral multiple (e.g., not less than (11 mm×π)/280 mm/sec). FIG. 8(*c*) schematically shows a potential relationship at a toner charging means opposing portion disposed downstream of the brush roller with respect to the photosensitive member rotational direction. The cleaning condition for the toner deposited on the toner charging means is substantially equal to that in Embodiment 1, thus being omitted from the description.

In this embodiment, the electrostatic image for the cleaning is formed in the following manner.

When an exposure time of the photosensitive drum 11 by the exposure means 3 is TL, a non-exposure time of the photosensitive drum 11 by the exposure means 3 is T, and a speed of the photosensitive drum 11 is v (=280 mm/sec), the following relationships are satisfied:

$$TL \times v = 212\ \mu m \text{ and } T/TL = 4$$

According to an experimental result by the present inventors, it was found that the following relationships may preferably be satisfied.

$$84.6\ \mu m \leq TL \times v \leq 847\ \mu m \text{ and } T/TL > 2$$

As described above, the cleaning control of the discharging means 24 is effected in the same manner as in the case of the toner charging means 15 in Embodiment 1.

According to the cleaning control in this embodiment, even in the case of the continuous image formation with 30% duty, the cleaning control was able to be effected in the cleaning control time of about 5 sec per 50 sheets. For this reason, the electrical damage on the photosensitive drum 11 and the discharging means 24 is about 1.08 times that in the case of no cleaning control, so that it is possible to realize that the durable lifetime is kept at a level of about 8% lowering. Similarly, by the reduction in time required for the cleaning control, compared with Comparative Embodiments 1 and 2, the substantial productivity was able to be improved. The results of the control time and the electrical damage with respect to the cleaning control in this embodiment (Embodiment 2) and Comparative Embodiments 1 and 2 are shown in Table 2.

TABLE 2

| | 30% duty test | | |
|---|---|---|---|
| | EMB. 2 | COMP. EMB. 1 | COMP. EMB. 2 |
| Control time (sec) | ca. 5 | ca. 15 | ca. 10 |
| Electrical damage (times) | 1.08 | ca. 1.25 | ca. 1.17 |

The control flow of the cleaning control method in this embodiment will be described. Incidentally, the hardware configuration for executing the following control flow is the same as in Embodiment 1 and thus will be omitted from the description.

(Control Flow)

Figure 9:
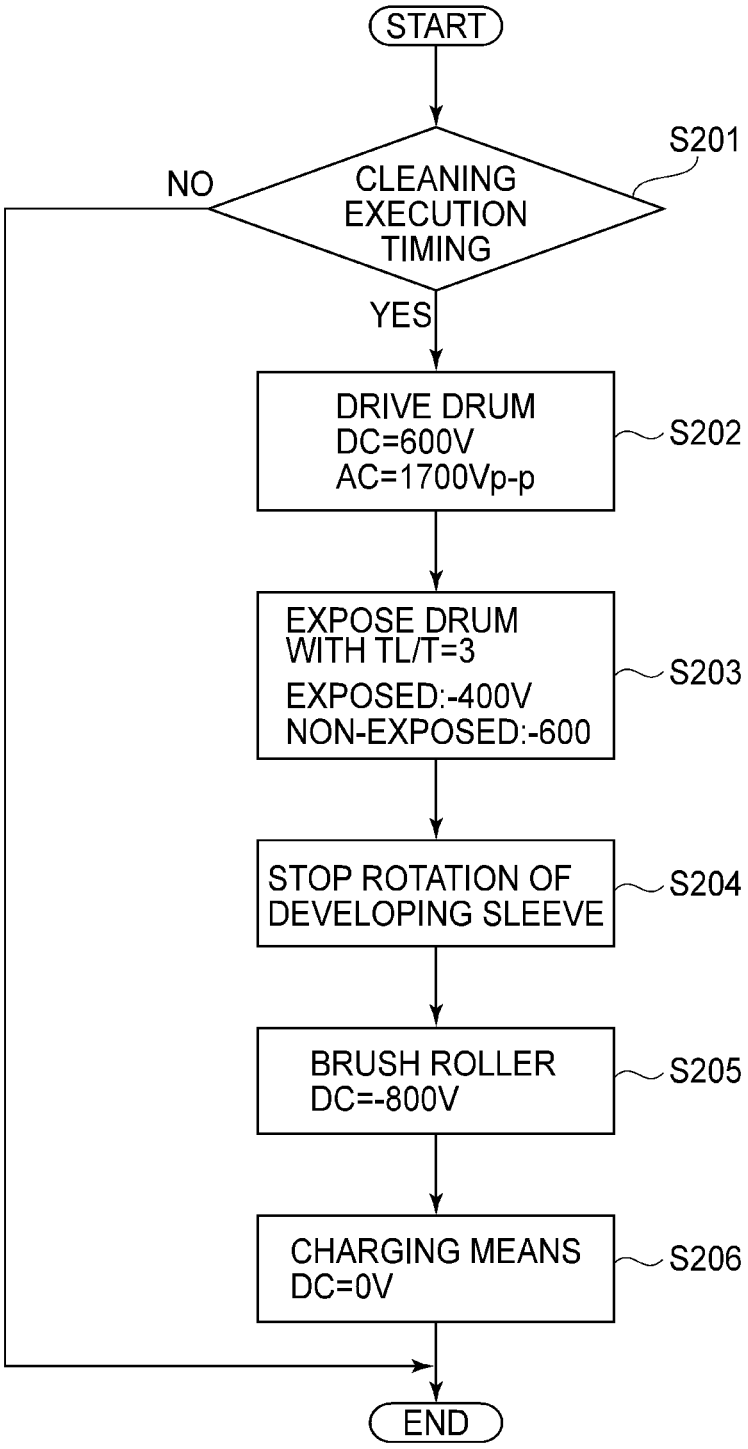
FIG. 9 is a flowchart for illustrating the cleaning control in Embodiment 2.

FIG. 9 is a flowchart for illustrating the cleaning control in this embodiment. The cleaning control is executed during the non-image formation other than during the image formation in which the image (toner image) to be transferred onto the sheet-like recording material is formed. Incidentally, steps S201, S202, S203, S204 and S206 are identical to the steps S101, S102, S103, S104 and S105, respectively, in Embodiment 1 and thus will be omitted from the description.

S205 is a control step for discharging the toner accumulated on the brush roller onto the photosensitive member. Specifically, the controller 200 applies the DC voltage of −800 V to the brush roller, so that the toner deposited on the brush roller is moved to the photosensitive member by the electric field formed between the photosensitive member and the brush roller.

As described above, by the constitution in this embodiment, the toner deposited on the discharging means 24 and the toner charging means 15 is efficiently subjected to the cleaning control. As a result, even with respect to the image formation at the high print ratio, the image forming apparatus capable suppressing the electrical damage on the photosensitive drum and the discharging member at a minimum level to realize improvement in lifetime of each of the photosensitive drum and the discharging means is provided.

Incidentally, in the above-described embodiments, the image forming apparatus of the intermediary transfer type in which the toner image on the photosensitive drum 11 is once transferred onto the intermediary transfer belt 16 as the recording medium and then is transferred from the intermediary transfer belt 16 onto the recording paper P is described. However, the present invention is not limited to the image forming apparatus of the intermediary transfer type. The present invention is also applicable to an image forming apparatus of a type in which the toner image on the photosensitive drum 11 is directly transferred onto the recording paper P as the recording medium conveyed by a transfer material conveying belt or the like. Further, the present invention is not limited to the color image forming apparatus but may also be applicable to a monochromatic image forming apparatus. These image forming apparatuses are well known in the art, thus being omitted from the description.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 264315/2009 filed Nov. 19, 2009 and 235526/2010 filed Oct. 20, 2010, which is hereby incorporated by reference.

What is claimed is:

1. An image forming apparatus comprising:

a photosensitive member;

a charging device configured to electrically charge said photosensitive member at a charging position;

an exposure device configured to expose to light said photosensitive member charged by said charging device to form an electrostatic image on said photosensitive member;

a developing device configured to develop the electrostatic image on said photosensitive member with toner to form a toner image, wherein said developing device includes a rotatable developing sleeve and effects development by rotating the developing sleeve;

a first transfer device configured to transfer the toner image from said photosensitive member onto an intermediary transfer member at a transfer position;

a second transfer device configured to transfer the toner image from the intermediary transfer member onto a recording material;

a toner charging device, disposed upstream of said charging position and downstream of said transfer position with respect to a rotational direction of said photosensitive member, said toner charging device is contacting with said photosensitive member and configured to electrically charge, at a toner charging position, the toner remaining on said photosensitive member without being transferred; and a controller configured to control said charging device, said exposure device and said developing device so that a plurality of stripe-shaped electrostatic images are formed substantially in parallel with a longitudinal direction of said photosensitive member on a surface of said photosensitive member and are arranged in the rotational direction of said photosensitive member and so that toner deposited on said toner charging device is discharged to said photosensitive member when the plurality of stripe-shaped electrostatic images pass through said toner charging device in a state in which the rotation of said developing sleeve in stopped.

2. An apparatus according to claim 1, wherein each of the plurality of stripe-shaped electrostatic images includes an exposed portion and a non-exposed portion which are adjacent to each other, and wherein said controller effects control so that a width of the exposed portion is smaller than a width of the non-exposed portion along the rotational direction of said photosensitive member.

3. An apparatus according to claim 1, further comprising:

an adjusting member, disposed upstream of said toner charging position and downstream of said transfer position with respect to the rotational direction of said photosensitive member, configured to adjust an electric charge of the toner to be charged by said toner charging device, wherein said adjusting member is supplied with a bias of an opposite polarity to a normal charge polarity of the toner during image formation.

4. An apparatus according to claim 1, wherein said toner charging device is a rotatable brush roller, and wherein said brush roller has an outer circumferential length which does not coincide with a substantially integral multiple of a width of one period of the plurality of stripe-shaped electrostatic images formed substantially in parallel with a longitudinal direction of said photosensitive member.

5. An image forming apparatus comprising:

a photosensitive member;

a charging device configured to electrically charge said photosensitive member at a charging position;

an exposure device configured to expose to light said photosensitive member charged by said charging device to form an electrostatic image on said photosensitive member;

a developing device configured to develop the electrostatic image on said photosensitive member with toner to form a toner image, wherein said developing device includes a rotatable developing sleeve and effects development by rotating the developing sleeve;

a transfer device configured to transfer the toner image from said photosensitive member onto a recording material at a transfer position on said photosensitive member;

a toner charging device, disposed upstream of said charging position and downstream of said transfer position with respect to a rotational direction of said photosensitive member, and said toner charging device is contacting with said photosensitive member and configured to electrically charge, at a toner charging position, the toner remaining on said photosensitive member without being transferred; and a controller configured to control said charging device, said exposure device and said developing device so that a plurality of stripe-shaped electrostatic images are formed substantially in parallel with a longitudinal direction of said photosensitive member on a surface of said photosensitive member and are arranged in the rotational direction of said photosensitive member and so that toner deposited on said toner charging device is discharged to said photosensitive member when the plurality of striped-shaped electrostatic images pass through said toner charging device in a state in which the rotation of said developing sleeve is stopped.

6. An apparatus according to claim 5, wherein each of the plurality of stripe- shaped electrostatic images includes an exposed portion and a non-exposed portion which are adjacent to each other, and wherein said controller effects control so that a width of the exposed portion is smaller than a width of the non-exposed portion along the rotational direction of said photosensitive member.

7. An apparatus according to claim 5, further comprising:

an adjusting member, disposed upstream of said toner charging position and downstream of said transfer position, configured to adjust an electric charge of the toner to be charged by said toner charging device, wherein said adjusting member is supplied with a bias of an opposite polarity to a normal charge polarity of the toner during image formation.

8. An apparatus according to claim 1, wherein said toner charging device is a rotatable brush roller, and wherein said brush roller has an outer circumferential length which does not coincide with a substantially integral multiple of a width of one period of the plurality of stripe-shaped electrostatic images formed substantially in parallel with a longitudinal direction of said photosensitive member.

* * * * *